US007874890B2

(12) United States Patent
Van Dan Elzen

(10) Patent No.: US 7,874,890 B2
(45) Date of Patent: Jan. 25, 2011

(54) YO-YO HAVING SIDE-LOCATED ROLLER MEMBERS

(76) Inventor: Hans W. Van Dan Elzen, 4750 S. Stallion Dr., Gilbert, AZ (US) 85297

( * ) Notice: Subject to any disclaimer, the term of this patent is extended or adjusted under 35 U.S.C. 154(b) by 162 days.

(21) Appl. No.: 12/013,450

(22) Filed: Jan. 13, 2008

(65) Prior Publication Data

US 2008/0171488 A1 Jul. 17, 2008

Related U.S. Application Data

(60) Provisional application No. 60/880,584, filed on Jan. 16, 2007.

(51) Int. Cl.
*A63H 1/30* (2006.01)

(52) U.S. Cl. ..... 446/250; 446/247; 446/248; 446/249

(58) Field of Classification Search ..... 446/247, 446/248, 249, 250
See application file for complete search history.

(56) References Cited

U.S. PATENT DOCUMENTS 1,793,151 A 2/1931 Asbury et al.
2,794,294 A * 6/1957 Frangos ..... 446/235
3,081,578 A * 3/1963 Mosher ..... 446/251
3,287,846 A * 11/1966 Frangos ..... 446/235
4,516,946 A * 5/1985 Rodarte ..... 446/46
5,874,119 A * 2/1999 Coleman et al. ..... 426/104
6,080,035 A * 6/2000 Pekarsky et al. ..... 446/250
6,206,749 B1 * 3/2001 Bell ..... 446/250
6,533,636 B2 * 3/2003 Holenstein et al. ..... 446/250
6,599,165 B1 * 7/2003 Van Dan Elzen ..... 446/250

OTHER PUBLICATIONS

AnY Miroc Yo-Yo, Yoyonation Website, Sold in US Dec. 30, 2005.

* cited by examiner

*Primary Examiner*—Gene Kim
*Assistant Examiner*—Joseph B Baldori
(74) *Attorney, Agent, or Firm*—Franklin Gubernick

(57) ABSTRACT

The invention is an improved yo-yo that has a rotatable, outwardly-facing roller on each of its two sides. Each roller has an outwardly-facing opening that is sized and shaped to facilitate a non-slip engagement between a finger and the roller. The opening also provides access to an O-ring that functions to secure the roller to the yo-yo.

18 Claims, 9 Drawing Sheets

YO-YO HAVING SIDE-LOCATED ROLLER MEMBERS

This application claims the benefit of U.S. Provisional application No. 60/880,584 filed Jan. 16, 2007.

FIELD OF THE INVENTION

The invention is in the field of user-manipulated toys. More particularly, the invention is an apparatus in the form of a yo-yo in which each of the yo-yo's sides includes a freely-rotatable roller member that may be contacted by a user's finger. Each roller member is secured to the yo-yo by an O-ring that may be accessed via an outwardly-facing opening in the roller member.

BACKGROUND OF THE INVENTION

Most yo-yos feature two disk-shaped side portions that are rigidly connected to each other, in a spaced-apart relation, by some form of axle structure. The side portions may be of a unitary or multi-part construction and are usually made out of plastic, wood and/or metal. The axle structure typically extends through the center of both side portions and can be a simple, single part structure, such as a wooden dowel, or be a more complex assembly of multiple parts. To reduce friction, many modern yo-yos employ an axle structure that includes a center-located rotatable member, such as a ball bearing unit, as the point of attachment for the yo-yo's tether.

A yo-yo tether is commonly in the form of a long string made from a plurality of cotton strands that are twisted together. To enable the securement of the tether to the axle structure, one end of the tether is usually adapted to have a loop that is positioned to encircle a center portion of the axle structure. The other end of the tether is usually tied to create a second loop that can be placed about one of a user's fingers to thereby secure the tether, and effectively the yo-yo, to the user's hand.

In a yo-yo's initial starting condition, the yo-yo's tether is wound about the axle structure and is secured to a user's finger. The user can then release/throw the yo-yo from his hand whereby the tether will rapidly unwind from about the axle structure with a concomitant rotation of the yo-yo's two side portions. When the tether fully unwinds from about the axle structure, the yo-yo may "sleep" at the end of the tether, whereby the yo-yo's side portions continue to spin without the tether rewinding on the axle structure. Once the yo-yo is sleeping, there are a number of tricks, such as "walk the dog," that a person can perform with the spinning yo-yo. A sleeping yo-yo is also often used to perform "string tricks" that involve temporarily placing the spinning yo-yo onto a portion of the tether intermediate of the tether's two ends.

Normally, at the finish of a yo-yo trick, the user of the yo-yo will make a quick jerk on the tether to cause the yo-yo to return to the user's hand. By jerking on the tether, the user briefly tightens the tether, which is then automatically followed by a temporary slackening of the tether. In most conventional yo-yo's, once the tether goes slack, the tether's twist will cause one, or multiple, portions of the tether located proximate the axle structure to move to the side and thereby engage at least one of the yo-yo's spinning side portions. Once an engagement has occurred, the tether portion can become locked to the contacted side portion. A locking engagement is usually due to the tether becoming snagged on the side portion's surface, or to a bunching of the tether against said side portion. Once a locking engagement has occurred, further rotation of the side portion winds the tether about the axle structure, thereby causing the yo-yo to return to the user's hand.

A relatively new way to use a yo-yo is to hold the yo-yo in one hand while it is sleeping/spinning. This is enabled when the yo-yo has rotatable endcaps on each of its side portions. Such a yo-yo can be used in the conventional manner, or the user can incorporate the ability to grab the spinning yo-yo into various new yo-yo tricks.

Mushroom-shaped, acorn-shaped and propeller-shaped rotatable endcaps are known in the art. Removal of these endcaps from a yo-yo typically requires the application of outwardly-directed force on the endcap. However, prior art securement structures used with rotatable endcaps have been problematic. If the securement structure employed to hold an endcap to the yo-yo allows said endcap to be easily removed, it is not uncommon for the endcap to inadvertently disengage from the yo-yo. If instead, the securement structure securing an endcap to the yo-yo makes the endcap difficult to remove, a user will often be disinclined to remove the yo-yo's endcaps. Since there are certain tricks in which the endcaps could snag the tether, a user faced with difficulty in removing the endcaps would either not perform the tricks, or use a different yo-yo to perform the tricks. This obviously reduces the yo-yo's versatility and desirability.

SUMMARY OF THE INVENTION

The invention is a yo-yo optimized for hand-held rotation. The yo-yo features rotatable endcaps, wherein each endcap comprises a user-engageable roller member. Each roller member has a center-located bore that features an outwardly-facing opening. To enable free rotation of the roller members, each roller member is attached to a ball bearing unit that is itself secured to the yo-yo via a removable fastener. The fastener is preferably in the form of an O-ring that effectively secures the ball bearing unit, and thereby the roller member, to the yo-yo. The opening in the roller member's bore enables ready removal of the fastener, and if left accessible, the center opening also provides an ideal non-slip engagement point for a user's finger.

A yo-yo having rotatable endcaps, as structurally and functionally described herein, provides numerous advantages over the prior art. Firstly, the outwardly-facing openings in the yo-yo's endcaps greatly facilitate installation and removal of said endcaps from the yo-yo. Said opening in each endcap allows ready access to the endcap's securement structure once the endcap is in place on the yo-yo. This enables the employment of a securement method that makes the endcaps easy to disconnect, while not making the endcaps prone to inadvertent disengagement from the yo-yo.

A second advantage of the invention rests in the disclosed O-ring securement system for the endcaps. The securement system enables extremely easy installation and removal of the endcaps. Once installed, the endcaps are free to spin while being securely attached to the yo-yo. By having the roller member portion of the endcap indirectly secured to the yo-yo, wherein the roller member is secured to a ball bearing unit and the ball bearing unit is secured to the yo-yo, the system allows for the use of a fastener that does not contact the roller member. This negates the need for the roller member to have strengthened and/or dedicated portions that would be needed if it had to directly contact a fastener. As a result, it is extremely easy to design a roller member that is well balanced and low in weight.

A third advantage of the invention is derived from the shape of the endcaps. Each endcap's concave outwardly-facing surface and/or center opening enhances a user's ability to grasp the yo-yo in a non-slip manner.

A fourth advantage of the invention resides in the design of the mounting surface for each endcap's ball bearing unit. The shape of the surface ensures that each endcap can spin in a wobble-free manner and with a rotational axis that is coaxial with the yo-yo's center of rotation.

Finally, the general design of each of the yo-yo's side portions provides a distinct advantage. Each side portion includes a disk-shaped body member that has an outwardly-extending portion that extends into the center of the side portion's roller member. This provides an extremely stable and strong support for the roller member.

DETAILED DESCRIPTION OF THE DRAWINGS

Figure 1:
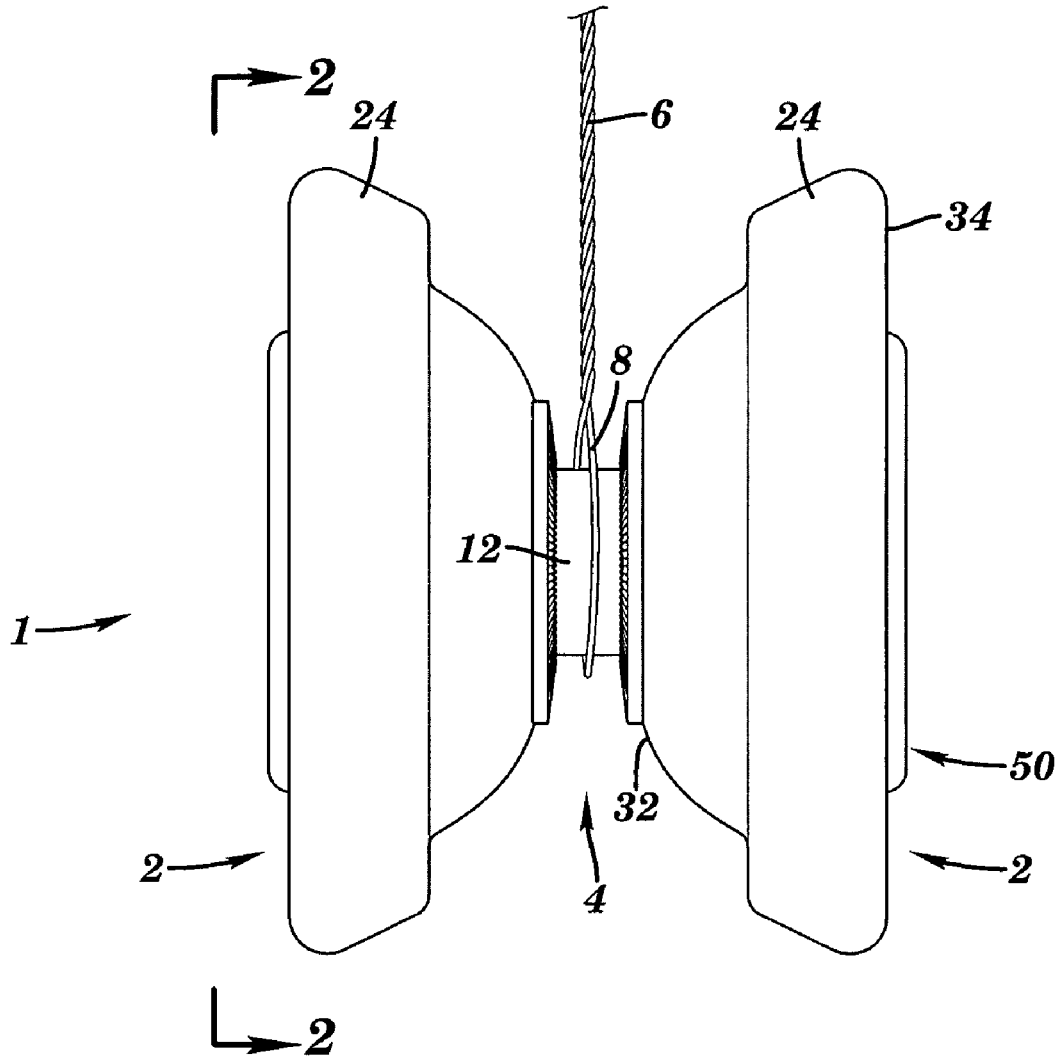
FIG. 1 is a front view of a yo-yo in accordance with the invention.
Figure 2:
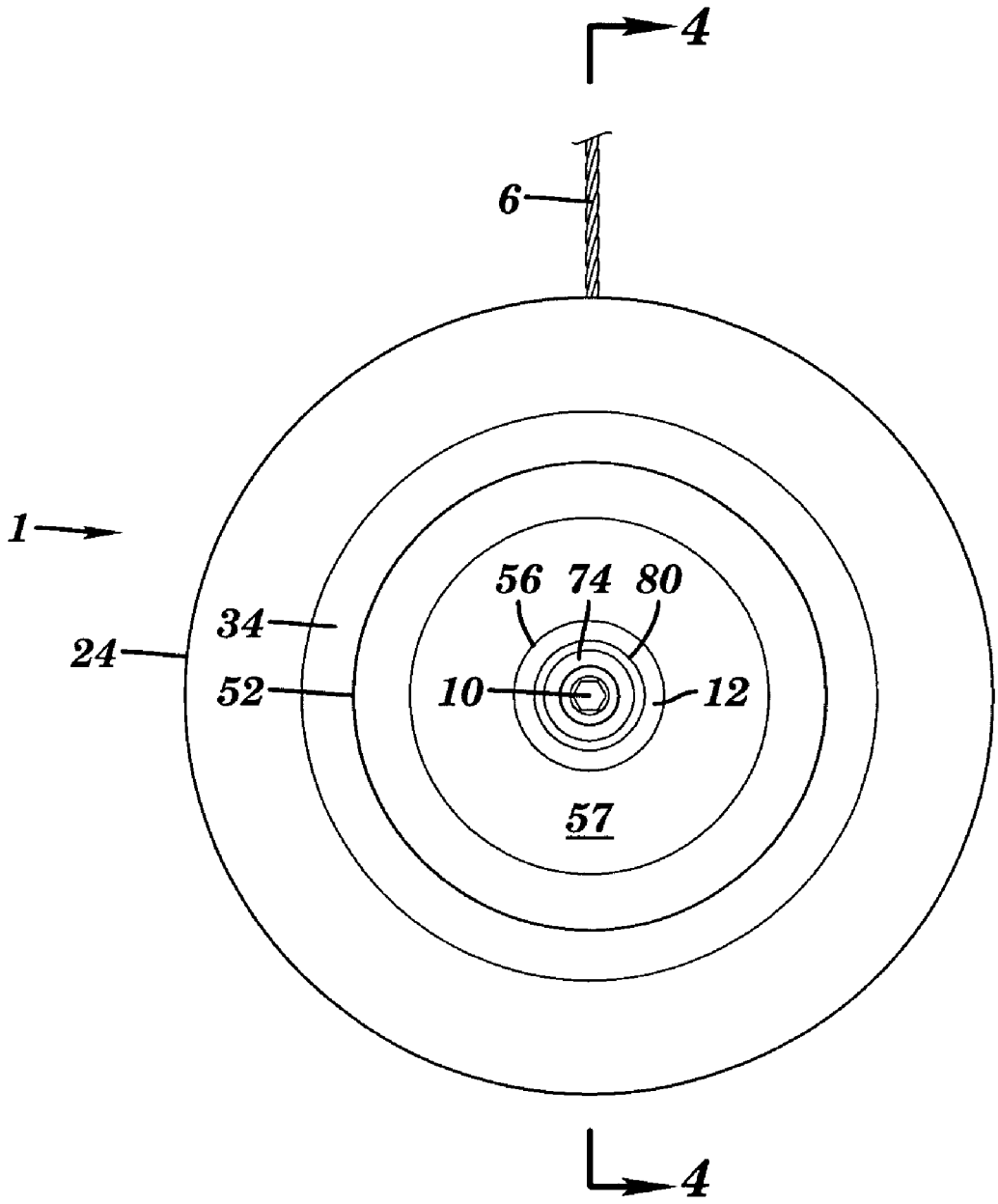
FIG. 2 is a side view of the yo-yo shown in FIG. 1, taken at the plane labeled 2-2 in FIG. 1.

Looking now to the drawings in greater detail, wherein like reference numerals refer to like parts throughout the several figures, there is indicated by the numeral 1 a yo-yo in accordance with the invention.

The yo-yo 1 includes first and second side portions 2 that are preferably substantially identical to each other and are connected together via an axle structure 4. A string-type tether 6 includes a loop portion 8 that encircles a center portion of the axle structure. The tether's distal end (not shown) will normally be tied to create a loop that enables a temporary securement of said end to one of a user's fingers.

Figure 5:
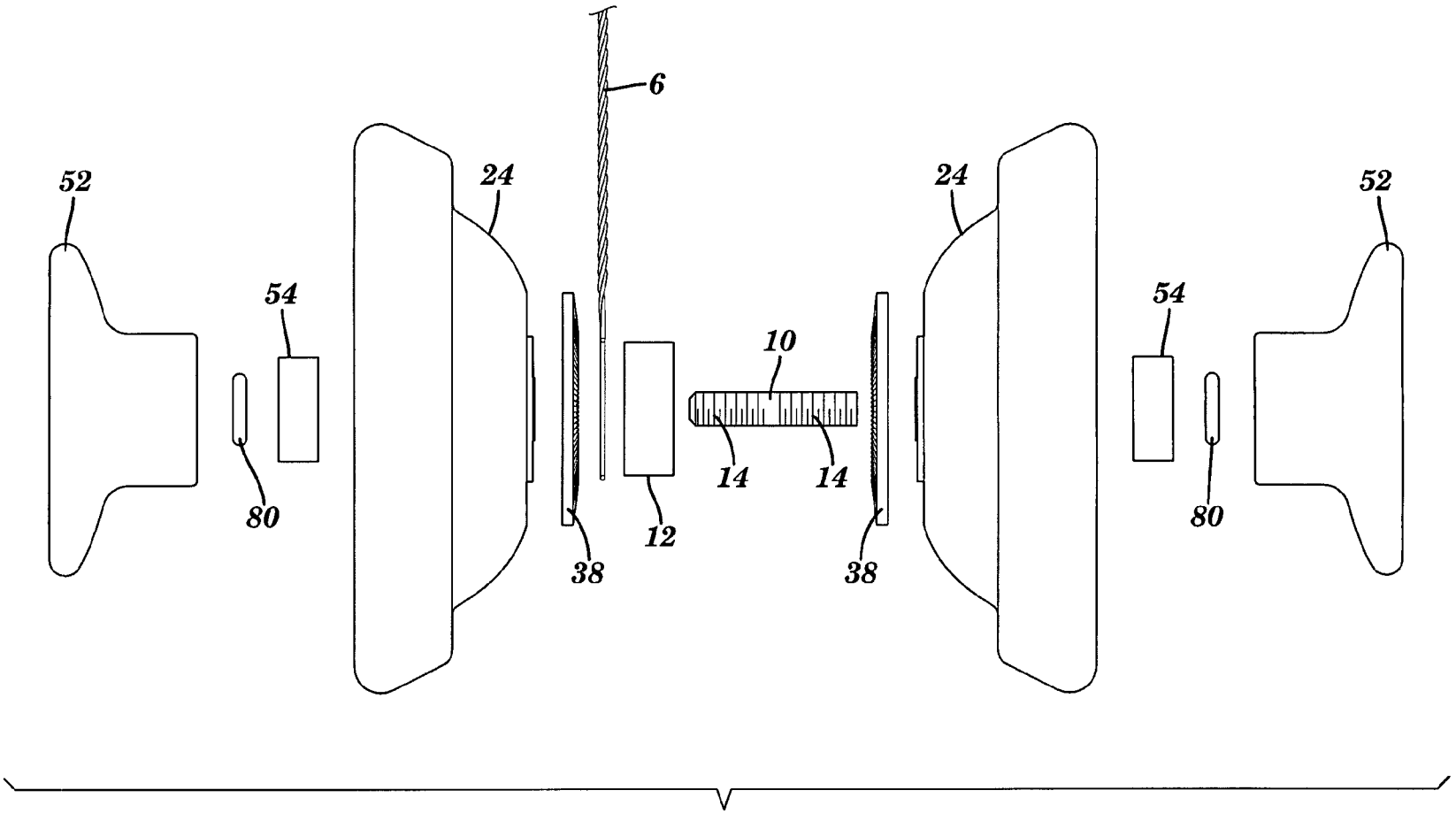
FIG. 5 is an exploded view of the yo-yo shown in FIG. 1.

The axle structure 4 is preferably an assemblage of parts (note FIG. 5) that includes an axle pin 10 and a ball bearing unit 12. The axle pin shown is a hex-socket setscrew that has exterior threads 14 at each end and a longitudinal axis co-linear to the yo-yo's preferred axis of rotation. The axle pin may alternatively be a threaded stud, bolt, or any other functionally equivalent fastener or connector.

The ball bearing unit 12 is preferably conventional in design and has an inner race 20 (note FIG. 4), an outer race 22 and a plurality of balls 23 located between said races. As shown, the ball bearing unit is located whereby it is centered on the axle pin and sandwiched between the yo-yo's two side portions. It should be noted that other known types of rotatable devices or members may be employed in place of the ball bearing unit shown. The ball bearing unit can even be dispensed with altogether when the yo-yo's tether is attached directly to the axle pin, to a structure fixedly secured to said pin, or to an equivalent structure that extends between the yo-yo's side portions.

Each side portion 2 includes a disk-shaped body member 24 that has a center-located thru-bore 26 having threads 28. The threads 28 are adapted to threadedly engage the exterior threads 14 of the axle pin 10. When opposite ends of the axle pin are threadedly engaged to the threads 28 of the yo-yo's body members 24, the axle structure will function to secure together the yo-yo's two side portions in a spaced-apart relation. Alternatively, an inwardly-threaded open-ended member such as a nut may be secured within bore 26 to take the place of the threads 28.

Each body member 24 has an inwardly-facing surface 32 and an outwardly-facing surface 34. Surface 32 is also known as a tether-facing surface since a portion of said surface will face the yo-yo's tether 6 when said tether is secured to the axle structure and extends outwardly from the yo-yo. Surface 34 is considered an outwardly-facing surface since it faces away from the yo-yo's string gap, the area located between the yo-yo's two side portions.

Located in surface 32 is a circular cavity 36 (note FIG. 6) into which is fixedly secured a ring-shaped tether engagement pad 38. Securement of the pad may be accomplished using an adhesive, interference fit, or any other conventional securement method/structure. The pad functions to facilitate engagement and/or snagging between the side portion and the tether should said tether move to a position whereby it contacts pad 38. It should be noted that the cavity and pad are optional.

Figure 3:
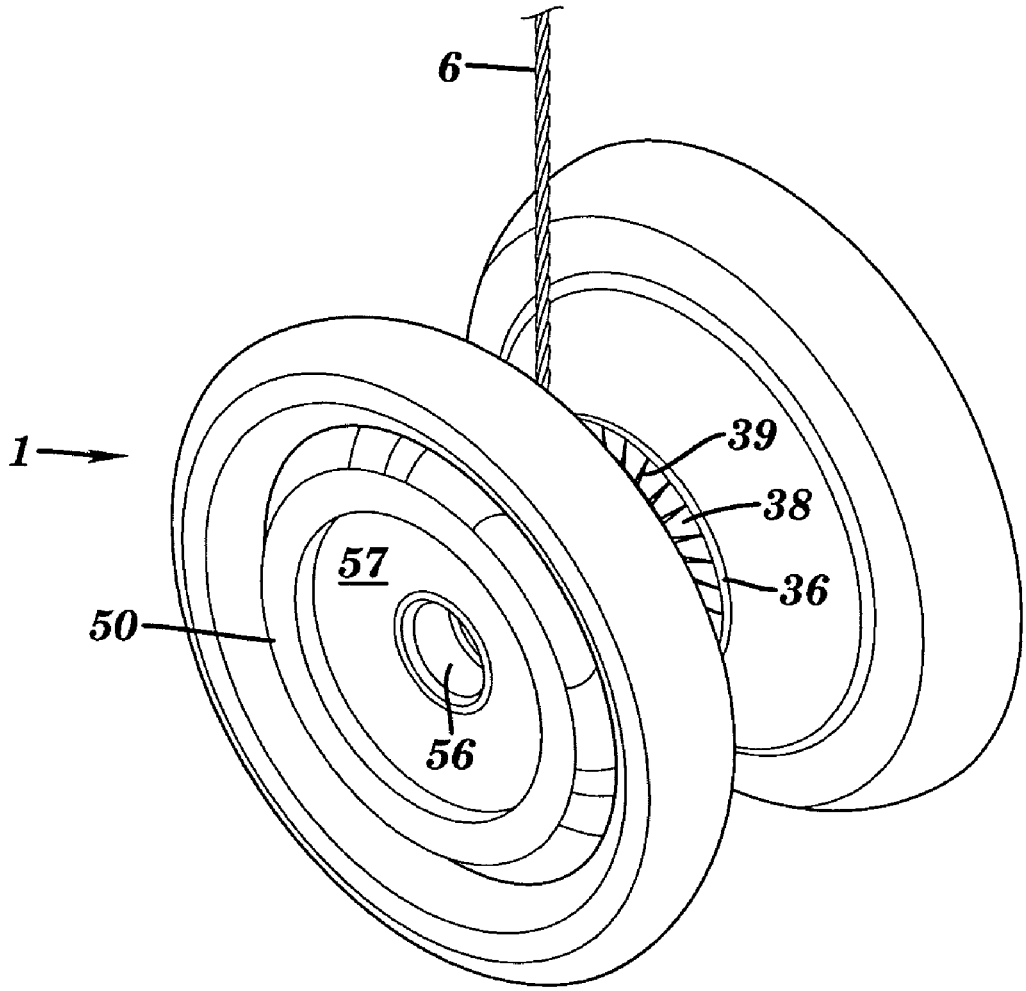
FIG. 3 is an isometric view of the yo-yo shown in FIG. 1.

The yo-yo's tether engagement pads 38 are preferably made of a plastic or rubber material and may include surface features, such as the raised ribs 39 shown in FIG. 3, that increase the pad's ability to engage/snag the tether. Alternatively, other structures adapted to engage the tether may be incorporated into said pads, or used as an alternative to, and in place of, said pads.

Figure 4:
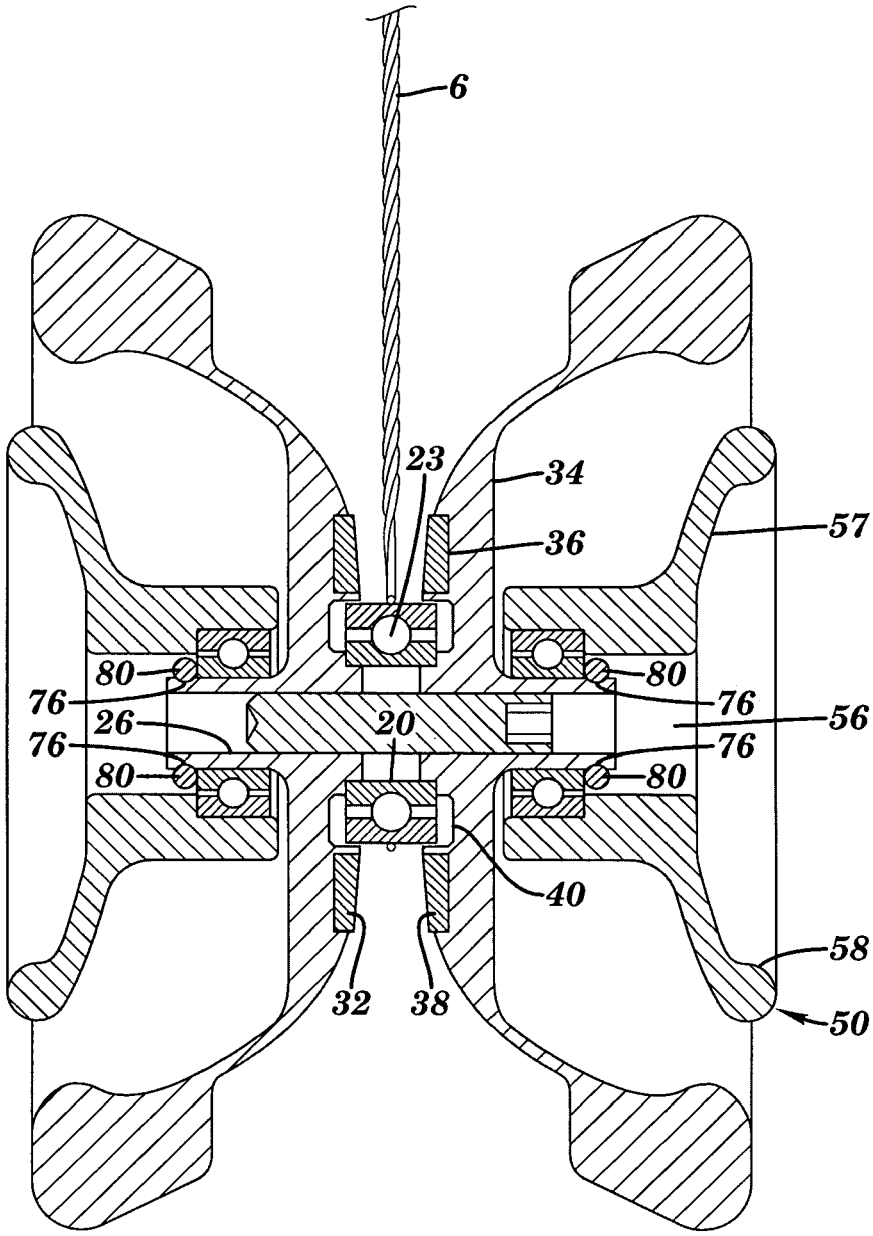
FIG. 4 is a cross-sectional view of the yo-yo shown in FIG. 1, taken at the plane labeled 4-4 in FIG. 2.

Surface 32 of the body member surrounds a centrally-located circular cavity 40 designed to inwardly receive a portion of the ball bearing unit 12. As can be seen in FIG. 4, the cavity is configured and situated whereby the ball bearing unit's inner race 20 contacts a ledge 42 located in the cavity. The ball bearing unit's outer race 22 is partially received in cavity 40 in such a manner whereby it does not contact any portion of the body member, and is thereby freely rotatable.

As can be readily seen in FIG. 4, located adjacent the outwardly-facing surface 34 of each body member is an endcap 50. The endcap is composed of a round roller member 52 and a ball bearing unit 54.

In the embodiment shown, the roller member has a diameter that is about one-half that of the body member. Alternatively, the roller member can have a different shape or size. For example, the roller member can have a shape similar to that of a simple wheel, or instead have a complex configuration designed to maximize user comfort and/or accessibility. The roller member may have a very small diameter, possibly as little as one-third of an inch, or have a much bigger diameter to a point where its diameter is greater than that of the adjacent body member.

Located at the center of the roller member is a thru-bore 55 that has an outwardly-facing opening 56. As will be described shortly, the opening has multiple functions and therefore preferably has a diameter of at least one-quarter of an inch. While a thru-bore is preferred, the body member or roller member may have a different configuration whereby the roller member may instead include a bore that has an outwardly-facing opening 56 but only extends partially through the roller member.

It should be noted that the roller member's outwardly-facing surface 57 is preferably concave and has a peripheral lip 58. The concave area forms a recess that, in combination with the lip 58, provides a contour that facilitates a user being able to place a finger onto the center of the roller member when the yo-yo is in use. This functionality is enhanced when opening 56 is left exposed, whereby the opening also forms a recess in the surface of the roller member. A user may then place the ball of a finger into said opening. When a user's finger is contacting opening 56 in this manner, the opening also functions to prevent the user's finger from slipping off the roller member. While not preferred, the opening 56 could be covered by an easily removable cap (not shown).

In the preferred embodiment, the roller member is made from a plastic, nylon, rubber or aluminum material whereby it has a low weight, and hence low inertia. A low inertia makes the roller member easy for a user to stop should it be spinning at a high rate of speed. Alternatively, the roller member can be made of a heavy material whereby the roller member would tend toward a stationary condition.

The roller member's thru-bore 55 also includes an inwardly-facing opening 59. This opening leads into a cylindrical cavity 60 in which is located the ball bearing unit 54. In the preferred embodiment, ball bearing unit 54 is substantially identical to the ball bearing unit 12 and includes an outer race 62, an inner race 64 and a plurality of balls 66 located between said races. Preferably, the outer race 62 firmly contacts an inner wall 70 of cavity 60 whereby significant effort is required to push ball bearing unit 54 out of cavity 60 once it has been received therein.

Figure 6:
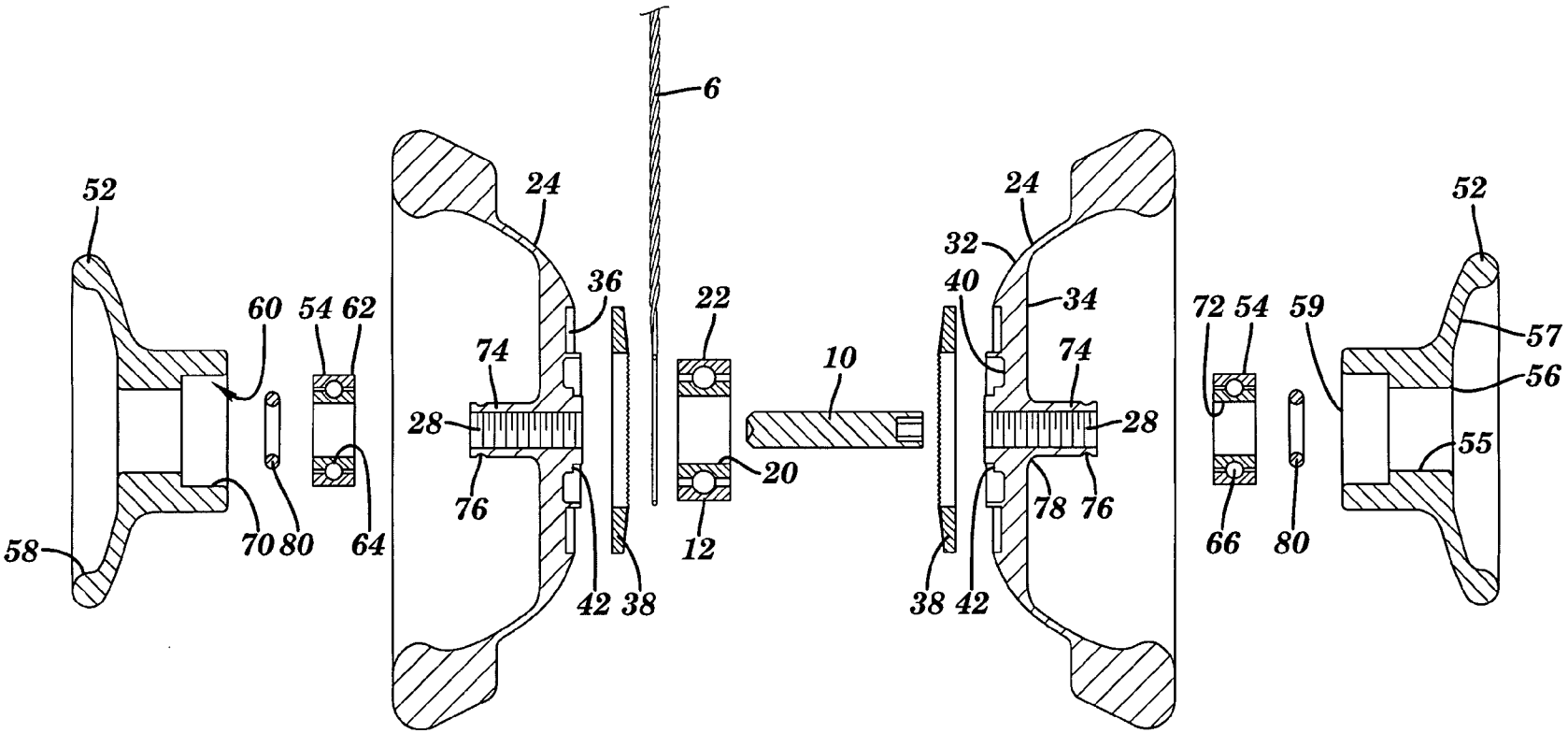
FIG. 6 is a cross-sectional exploded view of the yo-yo shown in FIG. 1, taken along the same plane as employed to create FIG. 4.

The inner race 64 of ball bearing unit 54 defines a thru-hole 72 that has a diameter that is equal to, or just slightly greater than, an outer diameter of an outwardly-extending portion 74 of the body member (note FIG. 6). Portion 74 is preferably cylindrically-shaped and is also herein referred to as a nipple portion. Located near a distal end of said nipple portion is a circumferential endless groove 76. Designed to be partially received within said groove is an O-ring 80 that is preferably made of a flexible, resilient material such as rubber.

When a user wishes to install a roller member 52 onto one of the body members, there are two methods that can be employed. In the first method, the user places the ball bearing unit 54 onto the body member's nipple portion 74 and slides it past the groove 76. The ball bearing unit is pushed inwardly, toward the center of the yo-yo, until a side of the unit's inner race 64 contacts a conical portion 78 of the nipple portion. This engagement acts to center the ball bearing unit and maintain its orientation whereby it axis of rotation should coincide with that of the body member. Once the ball bearing unit is properly positioned, the O-ring 80 is then pushed over the end of the nipple portion until it contracts into the groove 76. The O-ring is only partially received in the groove whereby the portion of the O-ring that extends outwardly from the groove functions to positionally maintain the ball bearing unit 54 on the nipple portion (note FIG. 4). The roller member is then positioned over the nipple portion in a manner whereby the ball bearing unit 54 enters the roller member's opening 59. The roller member is pushed closer to the body member until the ball bearing unit 54 is pressed into the roller member's cavity 60 and thereby becomes tightly secured to the roller member.

Once in place on the ball bearing unit, the roller member, by virtue of its securement to the outer race of the ball bearing unit, is secured to the yo-yo but can freely spin relative to the adjacent body member 24. Preferably, the inner race 64 of the ball bearing unit 54 closely fits on the exterior surface of the nipple portion 74 to maintain the proper orientation of the unit.

In the second method for installing a roller member, the user starts out with the ball bearing unit 54 located within the roller member's cavity 60. The user then places the roller member onto the body member's nipple portion 74, with said portion fitting through the ball bearing unit's thru-hole 72. Once the ball bearing unit is located past the groove 76, the O-ring is pushed into the thru-bore 55 via opening 56. A user can then employ a fingernail, toothpick or other elongated object to position the O-ring into the groove 76 via the opening 56. The O-ring then secures the ball bearing, and thereby the roller member, to the yo-yo.

A primary virtue of the invention is that it is extremely easy to remove the yo-yo's endcaps 50. A user simply has to disengage the fastener holding the endcap's ball bearing unit in place. In the embodiment shown, the user merely applies outwardly-directed pressure to a roller member 52 using his or her fingers, or with a tool such as a pair of pliers or a screwdriver. As the roller member moves outwardly, the associated ball bearing unit 54 applies outwardly-directed pressure on the adjacent O-ring 80. This causes said O-ring to roll out of the groove 76 and be free and unsecured within the thru-bore 55. The O-ring can then be easily removed via the thru-bore's outwardly-facing opening 56. Depending on the rapidity with which the roller member is moved outwardly, the O-ring can even be caused to pop out of said opening and into a user's hand. Once the O-ring is removed, the ball bearing unit and the roller member can slide off the body member's nipple portion 74 and thereby become disengaged from the side portion. It should be noted that only a properly directed force of a certain minimum amount would cause the disengagement of an endcap. As a result, any possibility of inadvertent disengagement of an endcap is minimized.

While an O-ring fitting into a groove is shown for securing each endcap 50 to the yo-yo, other known securement methods and/or structures may alternatively be employed. For example, an end portion of the nipple portion 74 may include external threads, and a nut having internal threads may be threaded onto said nipple portion to secure the ball bearing unit 54 to the nipple portion. As another alternative, if the thru-bore 26 that extends through the center of the nipple portion is threaded, a bolt may be threaded into said thru-bore. The bolt's head would preferably be sized and shaped to enable it to secure the ball-bearing unit 54 to the nipple portion 74.

Figure 7:
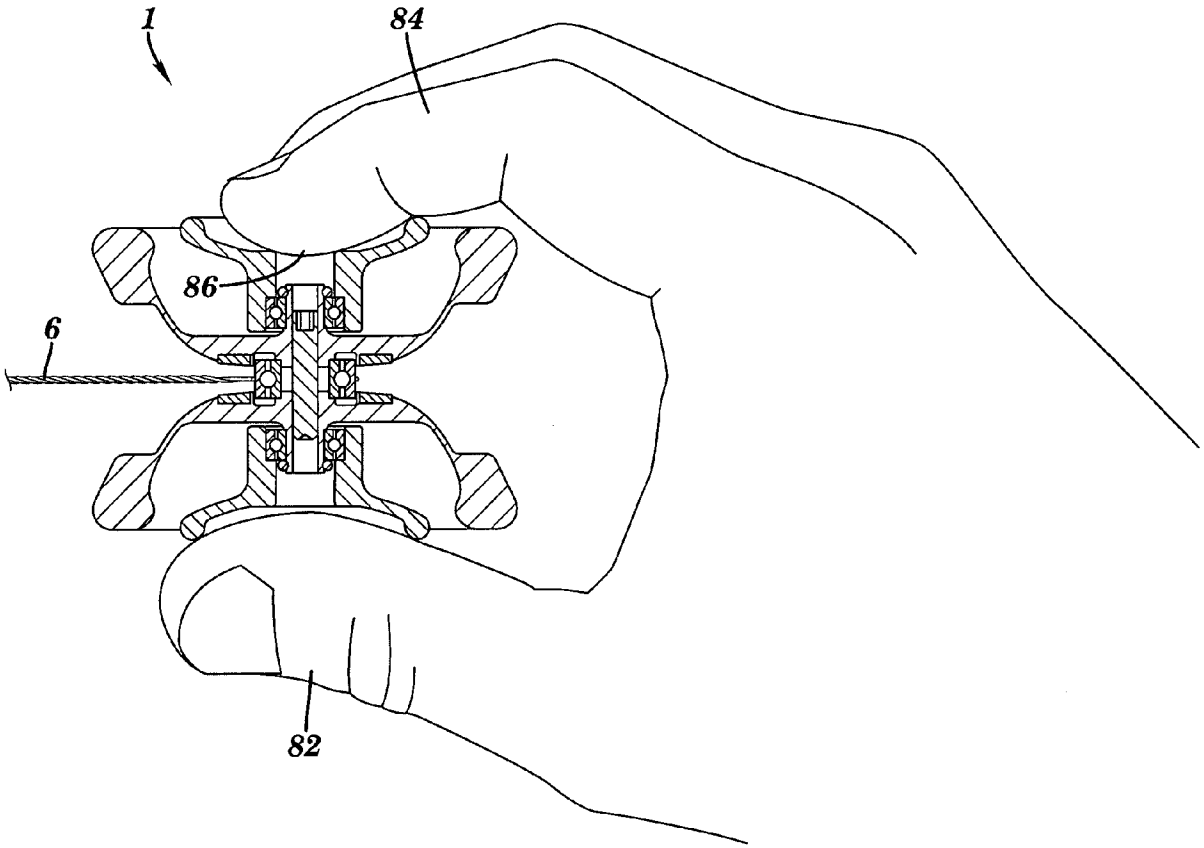
FIG. 7 provides a top view of the yo-yo shown in FIG. 1, with portions cut-away, and also shows a user's hand supporting the yo-yo.

When a user wishes to hold the yo-yo, either when it is stationary or when it is spinning, the user positions one finger on the center of one of the yo-yo's roller members, and another finger on the center of the yo-yo's other roller member. This is shown in FIG. 7 wherein the user's thumb 82 is in contact with one of the yo-yo's roller members, while one of the user's long fingers 84 contacts with the yo-yo's other roller member. In this manner, the yo-yo can freely spin without any portion, other than the freely-rotatable roller members, contacting the user's hand. The roller member's opening 56 is preferably of a size (preferably at least ¼ inch) and shape to accept the ball 86 of a finger. This enhances user comfort and the ability of the finger to not slip off the roller member.

Figure 8:
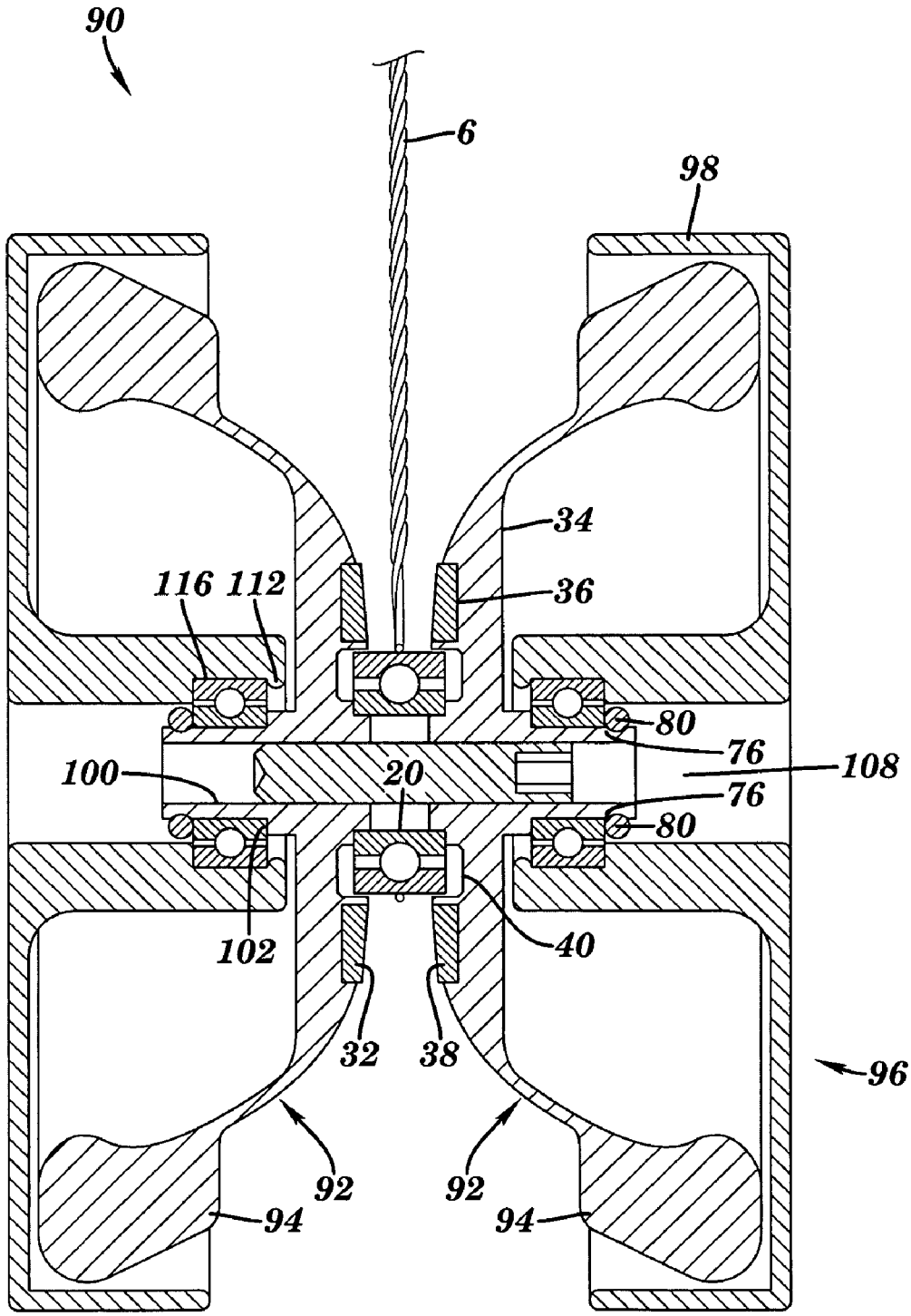
FIG. 8 provides a cross-sectional view of a second embodiment of a yo-yo in accordance with the invention.
Figure 9:
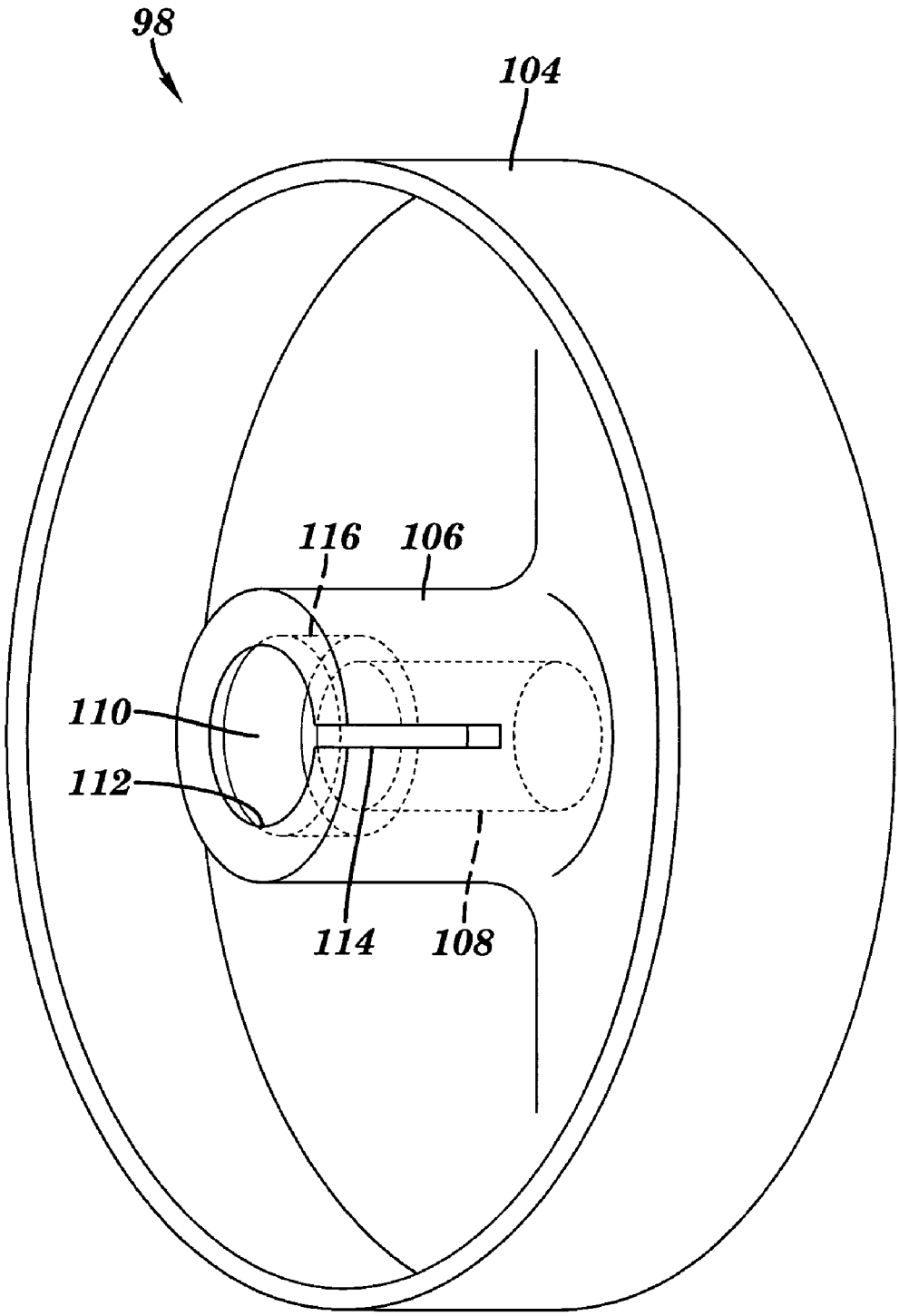
FIG. 9 provides an isometric view of one of the roller members employed in the yo-yo shown in FIG. 8.

FIG. 8 shows an alternate embodiment of a yo-yo 90 in accordance with the invention. In this embodiment, each of the yo-yo's side portions 92 has a body member 94 and an endcap 96. Each endcap 96 comprises a roller member 98 and ball bearing unit 54. As in the previous embodiment, an O-ring 80 fitting into a groove 76 in a nipple portion 100 of the body member 94 secures each endcap to the yo-yo.

In both embodiments of the yo-yo taught herein, the orientation of an endcap's ball bearing unit 54 directly affects the axis of rotation of the endcap. Preferably, the roller member portion of the endcap should have an axis of rotation that is collinear with that of the yo-yo. In yo-yo 1, the slanted exterior surface of each nipple portion's conically-shaped portion 78 acts to maintain the position and angle of the ball bearing unit in the desired manner. However, this positioning is more definitely achieved in yo-yo 90 by virtue of a flat seat 102 incorporated into the nipple portion 100 of each body member. The flat seat is oriented perpendicular to the axis of rotation of the body member and bears on the side of the ball bearing unit's inner race. This forces the ball bearing unit to have, and maintain, an orientation that enables the associated endcap to rotate with an axis of rotation collinear to that of the adjacent body member.

The shape and design of roller members 98 give them a unique functionality. As shown, each roller member has a peripheral portion 104 that extends over the adjacent body member. This allows a user to hold the yo-yo either in a manner similar to that depicted in FIG. 4, or by applying pressure to the peripheral portion 104 of one, or both, roller members.

It should also be noted that each roller member 98 has a centrally-located tubular portion 106 that has a thru-bore 108 equivalent to the thru-bore 55 of the previous embodiment. The thru-bore 108 has an inwardly-facing opening 110 formed by a lip 112. Opening 110 has a diameter less than the outer diameter of the ball bearing unit 54. The tubular portion also includes a slot 114 that extends into opening 110.

There are two methods that may be employed to install one of the endcaps onto the yo-yo. In a first method, a user first slides a ball bearing unit 54 onto a body member's nipple/outwardly-extending portion 100 until the unit's inner race 64 contacts the seat 102 located on the nipple portion. The O-ring 80 is then placed into the nipple portion's groove 76, thereby securing the ball bearing unit in the proper position. The roller member is then centered on the nipple portion and moved in a manner whereby the ball bearing unit's outer race 62 contacts the thru-bore's lip 112. As the user continues to push the roller member toward the yo-yo's body member, end 110 of the thru-bore temporarily expands by virtue of the slot 114.

Once past lip 112, the ball bearing unit 54 is received within a complementary cavity 116 in the thru-bore. The unit is preferably securely received within said cavity. As soon as the ball bearing unit is fully located within cavity 116, the unit no longer contacts lip 112 and end 110 returns to its normal configuration. The lip 112 then functions to lock the ball bearing unit within the cavity 116. In this manner, the cavity's sidewalls are not responsible for securing the ball bearing unit in place, as they are in the first embodiment. Once the ball bearing unit is in place in the cavity 116, subsequent installations of the roller member can employ an installation method identical to the second installation method detailed for the roller members of the first embodiment of the invention.

A yo-yo having rotatable endcaps in accordance with the invention can be used in a number of ways. When the user wishes, the yo-yo can be employed in the conventional manner, with or without the endcaps. If the endcaps will possibly interfere with the yo-yo's use, the disclosed securement structure enables each endcap to be easily removed. Furthermore, the design of each endcap facilitates the performance of new tricks that require grabbing and holding of the yo-yo by said endcaps.

It should be noted that the taught endcaps and securement structure for said endcaps may be used with other types and shapes of yo-yos. It should also be noted that while each of the yo-yos taught herein is shown having substantially identical side portions, non-identical side portions may alternatively be employed in the same yo-yo. In addition, a yo-yo in accordance with the invention may employ a rotatable endcap on only a single one of its side portions.

The preferred embodiments of the invention disclosed herein have been discussed for the purpose of familiarizing the reader with the novel aspects of the invention. Although preferred embodiments of the invention have been shown and described, many changes, modifications and substitutions may be made by one having ordinary skill in the art without necessarily departing from the spirit and scope of the invention as described in the following claims.

I claim:

1. A yo-yo comprising:

first and second side portions;

an axle structure that secures together said side portions in a spaced-apart relation, and wherein a tether can be secured to a portion of said axle structure that is located between said side portions; and wherein said first side portion includes a roller member and a body portion, wherein said body portion has a peripherally-located rim portion, wherein said roller member is located whereby it is capable of being readily contacted by a finger of a user, wherein said roller member is rotatably secured to the yo-yo in a manner whereby said roller member is rotatable relative to said body portion, wherein said roller member has a thru-bore that includes, at opposite ends thereof, first and second openings, wherein said first opening faces toward said second side portion, wherein said second opening faces outwardly in a direction away from said second side portion, wherein a securement member functions to releasably secure said roller member to the yo-yo, wherein said roller member is rotatable relative to said securement member, and wherein when said second opening is accessible to a user, said securement member can be removed from said yo-yo via said second opening wherein a ball bearing unit is engaged to said roller member, wherein said ball bearing unit has a center-located thru-bore into which an outwardly-extending portion of the body member extends, wherein said securement member is engaged to a distal portion of said outwardly-extending portion in a manner whereby at least a portion of said securement member is located outwardly of said ball bearing unit and is thereby located further away from the second side portion that is the ball bearing unit, and wherein said securement member functions to prevent said ball bearing unit from moving outwardly and thereby disengaging from said outwardly-extending portion and thus secures said roller member to said yo-yo.

2. The yo-yo of claim 1 wherein said second opening has a diameter of at least one-quarter of an inch.

3. The yo-yo of claim 1 wherein an outer surface of said distal portion of said outwardly-extending portion of the body member features a circumferentially-extending groove, and wherein said securement member is removable and is in the form of an O-ring that is received into said groove in a manner whereby at least a portion of said O-ring extends outwardly from said groove and contacts an outwardly-facing side portion of said ball bearing unit.

4. The yo-yo of claim 1 wherein said outwardly-extending portion of said body member includes a flat surface oriented perpendicular to a longitudinal axis of said outwardly-extending portion, and wherein said surface is located inwardly of said ball bearing unit and is capable of contacting a side portion of an inner race of said ball bearing unit.

5. The yo-yo of claim 1 wherein the ball bearing unit is a tight fit in said roller member to an extent whereby when the securement member is removed, pulling the roller member away from the body member also causes the ball bearing unit to move away from the body member.

6. The yo-yo of claim 1 wherein said second opening is uncovered and has a shape and size that functions to enhance an ability of a user to engage said second opening with a finger.

7. The yo-yo of claim 1 wherein said securement member is made of a resilient material.

8. A yo-yo comprising:

first and second side portions secured together in a spaced-apart relation by an axle structure;

a tether secured to a portion of said axle structure; and wherein said first side portion includes a disk-shaped body member and a roller member, wherein said roller member is removably and rotatably secured to said yo-yo and is located adjacent said body member in a manner whereby a user can place a finger on said roller member when said yo-yo is spinning, wherein said roller member is secured to the yo-yo by a securement member in a manner whereby said roller member is rotatable relative to said body member, and wherein said roller member features an outwardly-facing opening through which said securement member may be accessed; and wherein said roller member has a thru-bore, wherein said outwardly-facing opening is located at one end of said thru-bore, wherein located at an opposite end of said thru-bore is a second opening that faces said body member, and wherein said body member includes an outwardly-extending portion that extends through said thru-bore of said roller member, wherein said securement member is engaged to a distal portion of said outwardly-extending portion of said body member.

9. The yo-yo of claim 8 wherein said outwardly-extending portion of said body member is cylindrical and has a bore into which is received a portion of the axle structure.

10. The yo-yo of claim 8 wherein said first side portion also includes a ball bearing unit engaged to said roller member and at least partially located within the roller member's thru-bore, and wherein the outwardly-extending portion of the body member extends through a center opening in said ball bearing unit in a manner whereby said outwardly-extending portion contacts and supports said ball bearing unit.

11. The yo-yo of claim 10 wherein said thru-bore extends through a tubular portion of said roller member, wherein said tubular portion includes an elongated slot that extends in a direction parallel to a longitudinal axis of said tubular portion, and wherein said slot facilitates expanding an end portion of said tubular portion to enable said ball bearing unit to be placed within said tubular portion.

12. The yo-yo of claim 10 wherein said thru-bore extends through a tubular portion of said roller member, and wherein said tubular portion includes a lip that extends toward a longitudinal center axis of said tubular portion and functions to secure said ball bearing unit within said roller member.

13. A yo-yo comprising:

first and second side portions secured together in a spaced-apart relation by an axle structure;

a flexible, elongated tether secured to a portion of said axle structure; and wherein said first side portion includes a disk-shaped body member and a freely-rotatable endcap, wherein said endcap is at least partially located outwardly of a center portion of said body member, is user-engageable and includes a roller member and a ball bearing unit securely held within a portion of said roller member wherein said ball bearing unit has a center-located thru-hole, wherein said body member includes an outwardly-extending portion that extends through said thru-hole, wherein a distal portion of said outwardly extending portion of said body member includes a circumferentially-extending endless groove, and wherein a removable O-ring is received within said groove and is located adjacent and outwardly of a side portion of said ball bearing unit in a manner whereby a portion of said O-ring extends outwardly from said groove and functions to secure said ball bearing unit to said body member which thereby secures said roller member to the yo-yo.

14. The yo-yo of claim 13 wherein said endcap has an outwardly-facing surface that includes a recess into which a user may place at least a portion of a finger.

15. The yo-yo of claim 13 wherein said roller member is in the shape of a wheel.

16. The yo-yo of claim 13 wherein said roller member has a concave outwardly-facing surface.

17. The yo-yo of claim 13 wherein said roller member has an outwardly-facing opening through which a user can access said O-ring.

18. The yo-yo of claim 13 wherein said o-ring is made of a resilient material.

* * * * *